United States Patent [19]

Mastro

[11] Patent Number: 4,946,170

[45] Date of Patent: Aug. 7, 1990

[54] MULTI-USE BOARD GAME

[76] Inventor: Anthony V. Mastro, 2728 Kreider Rd., Lititz, Pa. 17543

[21] Appl. No.: 385,947

[22] Filed: Jul. 27, 1989

Related U.S. Application Data

[63] Continuation of Ser. No. 114,839, Nov. 30, 1987, abandoned.

[51] Int. Cl.[5] ..... A63F 3/00

[52] U.S. Cl. ..... 273/258; 273/284; D21/33

[58] Field of Search ..... 273/258, 261, 260, 292, 273/248, 284; D21/23, 24, 33, 34

[56] References Cited

U.S. PATENT DOCUMENTS

| | | | |
|---|---|---|---|
| D. 120,643 | 5/1940 | Jones | 273/242 |
| D. 123,508 | 11/1940 | Moore | D21/25 |
| 161,502 | 3/1875 | Gilbert | 273/284 |
| 1,114,717 | 10/1914 | Buchon | 273/258 |
| 2,292,603 | 8/1942 | Bollenbach | 273/258 |
| 2,364,814 | 12/1944 | Plummer et al. | 273/284 |
| 3,920,247 | 11/1975 | Jenkins | 273/261 |

FOREIGN PATENT DOCUMENTS

| | | | |
|---|---|---|---|
| 2902 | of 1909 | United Kingdom | 273/261 |
| 2033239 | 5/1980 | United Kingdom | 273/261 |

*Primary Examiner*—Benjamin Layno

*Attorney, Agent, or Firm*—Neuman, Williams, Anderson & Olson

[57] ABSTRACT

A board game having a game board which can accommodate four players or six players. The game board has playing surfaces on opposite sids thereof. A first playing surface which accommodates four players is divided into four playing areas and each playing area is divided into identical playing spaces. Players are assigned a playing area and the player's playing pieces are placed in the respective playing areas. The playing pieces move along the playing surface and opposing playing pieces may be captured. A second surface on the opposite side of the board discloses another embodiment of the game wherein the second playing surface is divided into six playing areas, one playing area assigned to each player.

3 Claims, 3 Drawing Sheets

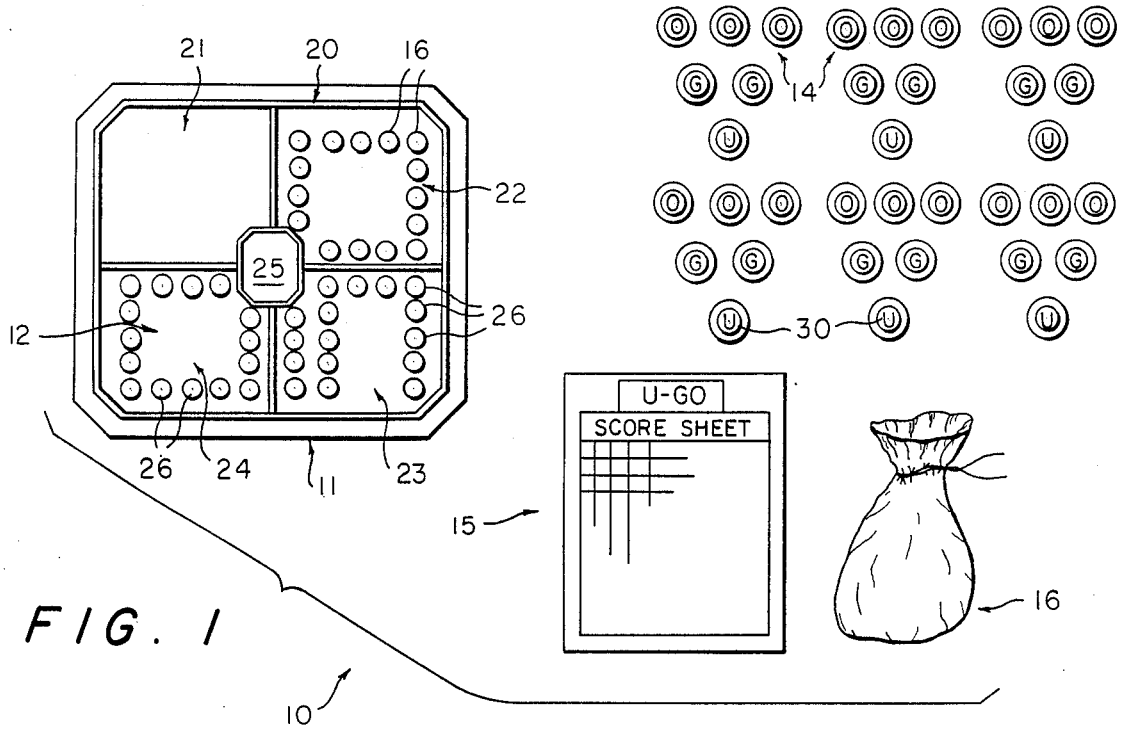
FIG. 1
FIG. 2
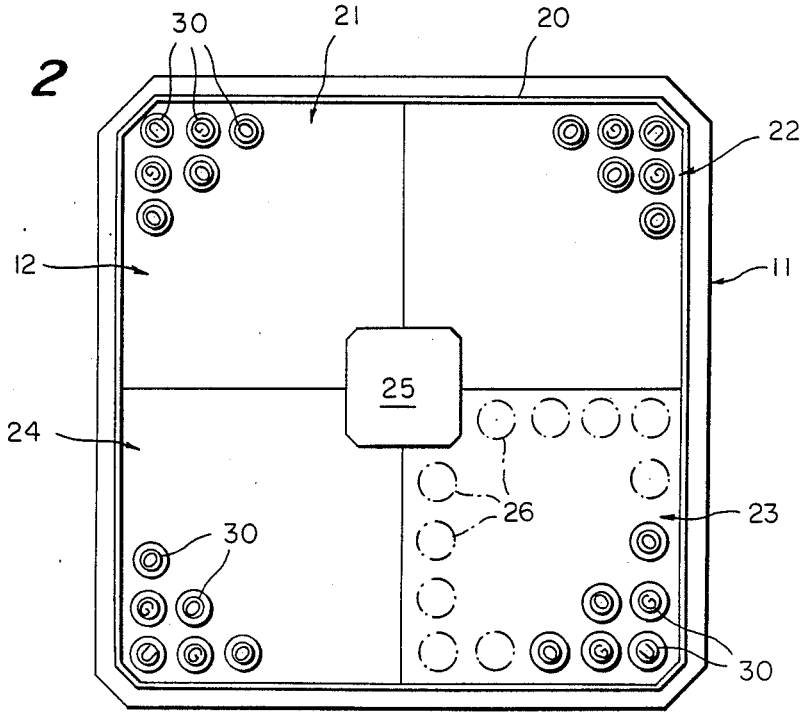

FIG. 3
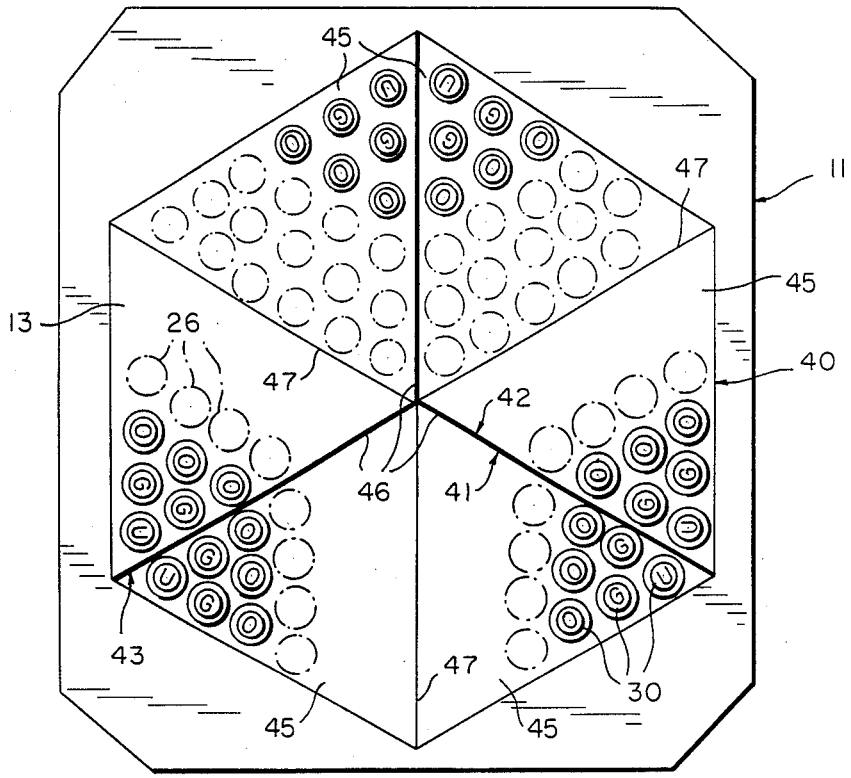
FIG. 4
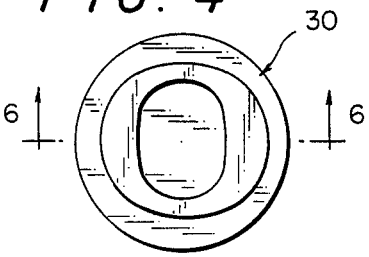
FIG. 5
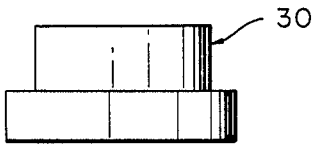
FIG. 6
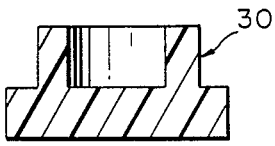
FIG. 7
U - GO
| SCORE SHEET | PLAYER NO'S. | | | | | |
|---|---|---|---|---|---|---|
| GAMES PLAYED | | | | | | |
| 1 | | | | | | |
| 2 | | | | | | |
| TOTAL | | | | | | |
| 3 | | | | | | |
| TOTAL | | | | | | |
| 4 | | | | | | |
| TOTAL | | | | | | |
| 5 | | | | | | |
| TOTAL | | | | | | |
| 6 | | | | | | |
| TOTAL | | | | | | |
| 7 | | | | | | |
| TOTAL | | | | | | |
15

MULTI-USE BOARD GAME

This is a continuation of co-pending application Ser. No. 114,839 filed on Oct. 30, 1987, now abandoned.

FIELD OF THE INVENTION

This invention relates to board games, and more particularly, to a board game having related but differently configured playing surfaces on opposite sides thereof.

DESCRIPTION OF THE PRIOR ART

Many different types of board games are known in the prior art, in which one side of a board is marked with indicia defining a playing surface over which playing pieces are moved in accordance with specified rules. In some such prior art games, the rules provide for variation in the number of players participating in a game, or even in the specific manner or rules for playing a particular game.

Other prior art games have playing boards which are marked with indicia on opposite sides thereof defining two entirely different games which may be played on opposite sides of the board, respectively, according to completely different rules.

DESCRIPTION OF THE INVENTION

It is an object of the present invention to provide a board game in which a playing board is marked with indicia on both sides, defining related but distinct playing areas.

Another object of the invention is to provide a board game in which a playing board is marked with related but distinct indicia on the opposite sides, defining two related playing surfaces on which similar but different games may be played.

BRIEF DESCRIPTION OF THE DRAWINGS

These and other objects and advantages of the invention will become apparent from the following detailed description taken in conjunction with the accompanying drawings, in which like reference characters refer to like parts throughout the several views, and wherein:

FIG. 1 is an exploded plan view of the various components comprising the board game of the invention;

FIG. 2 is a plan view of a first side of the game board of the invention;

FIG. 3 is a plan view of a second side of the game board of the invention;

FIG. 4 is an enlarged plan view of one of the playing pieces of the game of the invention;

FIG. 5 is a side view in elevation of the playing piece of FIG. 4;

FIG. 6 is a transverse sectional view of the playing piece of FIGS. 4 and 5, taken along line 6—6 in FIG. 4;

FIG. 7 is a plan view of the score card or sheet used in the game of the invention;

DESCRIPTION OF THE PREFERRED EMBODIMENTS

Figure 8:
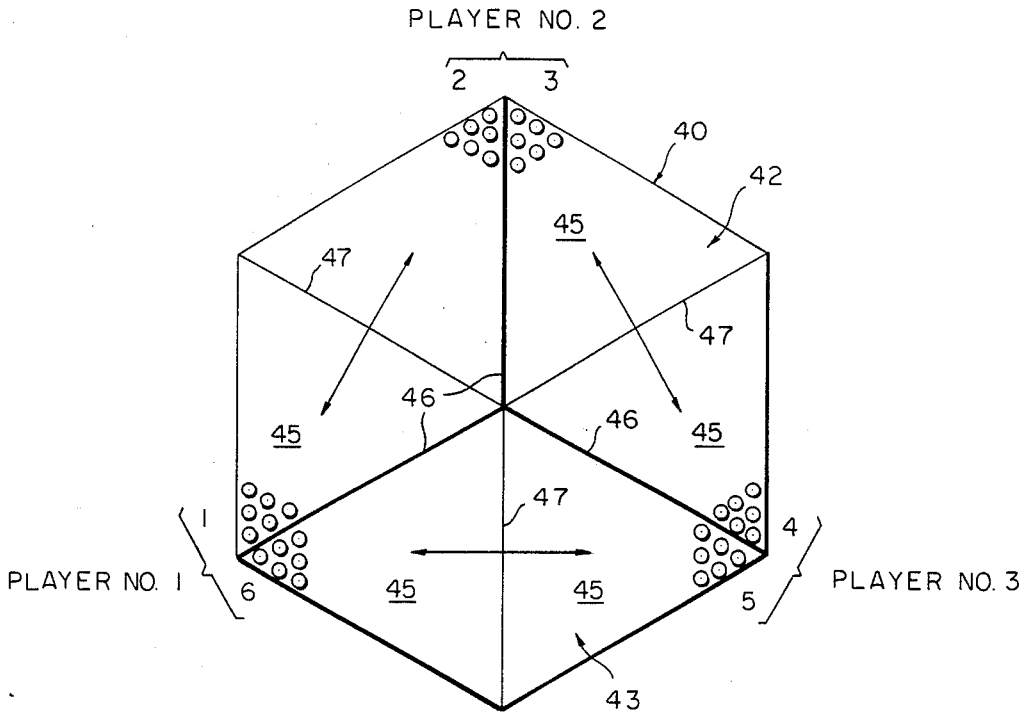
FIG. 8 is a schematic plan view of the second side of the playing board, showing representationally how three different players can be arranged to play two opponents simultaneously.

Referring more particularly to the drawings, the game is indicated generally at 10 in FIG. 1 and comprises a game board 11 having first and second opposite sides 12 and 13, respectively, a plurality of sets of playing pieces 14, a game score sheet 15 and a game bag 16 in which playing pieces may be stored and from which playing pieces may be drawn to determine the order of play at the beginning of a game.

The game board 11 is formed of a relatively rigid material such as cardboard or the like and has a first set of indicia 20 on the first side 12 thereof, defining a first playing surface of generally rectangular configuration and subdivided into four substantially equal playing areas 21, 22, 23 and 24. A blank or open area 25 is left at the center of the playing surface.

Each playing area 21, 22, 23 and 24 is divided into a plurality (shown as 24 in number in the specific example illustrated) of circular spaces 26 arranged in straight lines parallel to the sides of the playing surface and defining playing spaces on which the playing pieces must be moved. During play, the playing pieces must be moved across the short distance separating one space from the immediately adjacent spaces, and may not be moved diagonally across the relatively wide distance separating remotely adjacent spaces. The playing piece may be moved in either a forward, backward or side-to-side direction to the next adjacent space, and may move anywhere on the playing surface except in the central open area 25.

At the beginning of a game, all of the playing pieces will be placed in the game bag 16 and the players will draw a playing piece from the game bag to determine the order of play. The first player to pick a "U" piece starts the game, and the second, third and fourth players are similarly determined.

Either two or four players will each acquire six playing pieces 30 of the same color, including three "O's", two "G's" and one "U" and will arrange these six playing pieces in a "home" corner as shown in FIG. 2.

In order of superiority, the "U" playing piece takes a "G", the "G" takes an "O" and the "O" takes a "U". When a player's next move will occupy his opponent's present space, the opponent's playing piece is "taken". Play is initiated and continued, one space at a time, until a player maneuvers his "U" playing piece into his opponent's "home" corner or "takes" his opponent's "U" playing piece. The player accomplishing either of these feats is considered the winner of the game.

A more extended version of the game may be played in accordance with a "point system", in which each playing piece has a point value assigned to it as follows: "U"=30 points; "G"=20 points; and "O"=10 points. In addition, a 100 point bonus is awarded to a player for each opponent he defeats. Any suitable total point value (400, for example) may be assigned as a winning score, and a game will be over only when a player has accumulated this point total. The playing pieces are scored by counting the value of all of a player's playing pieces remaining on the board at the time a player has defeated his opponent. Each player is awarded a point score according to the value of his playing pieces remaining in play at the conclusion of a game, and the first player to accumulate the designated total point score is considered the grand winner.

A stalemate is declared after three moves in the same location by each player. The player making the seventh move must go in a different direction to break the stalemate and cause the game to proceed. When no move is possible, the offensive player is declared the winner.

For play on the playing surface 20 on the first side 12 of the playing board, each player is allowed to maneuver his playing pieces in all of the areas 21, 22, 23 and 24, but must go around the central open area 25. Each player plays the opponent diagonally opposite him.

The second side 13 of the game board has a hexagonally shaped playing surface 40 thereon, divided into three equal diamond-shaped segments 41, 42 and 43, with each segment divided into two equilateral triangularly shaped areas 44 and 45. Each area 44 and 45 has twenty-one circular playing spaces 26 therein, arranged along straight lines parallel to the sides of the respective triangular area.

As seen best in FIG. 3, the segments 41, 42 and 43 are defined by relatively heavy lines 46, while the triangularly shaped areas 44 and 45 in each segment are separated from one another by a relatively thin line 47.

The playing pieces are arranged as shown in FIG. 3, whether three or six players are participating. If three players are participating, then the play is organized as shown schematically in FIG. 8, and if six players are participating, play is organized as shown schematically in FIG. 9.

Each player is limited to moving his playing pieces only in the diamond shaped segment, 41, 42 or 43, in which those pieces are originally arranged.

In one variation of the game, three players using two sets of playing pieces each may participate. In this variation, each player occupies two adjacent corners of the segments, and will be playing two opponents at the same time (see FIG. 8). The first player to defeat his two opponents is declared the winner. In all other respects, the rules and scoring are the same as previously described.

Figure 9:
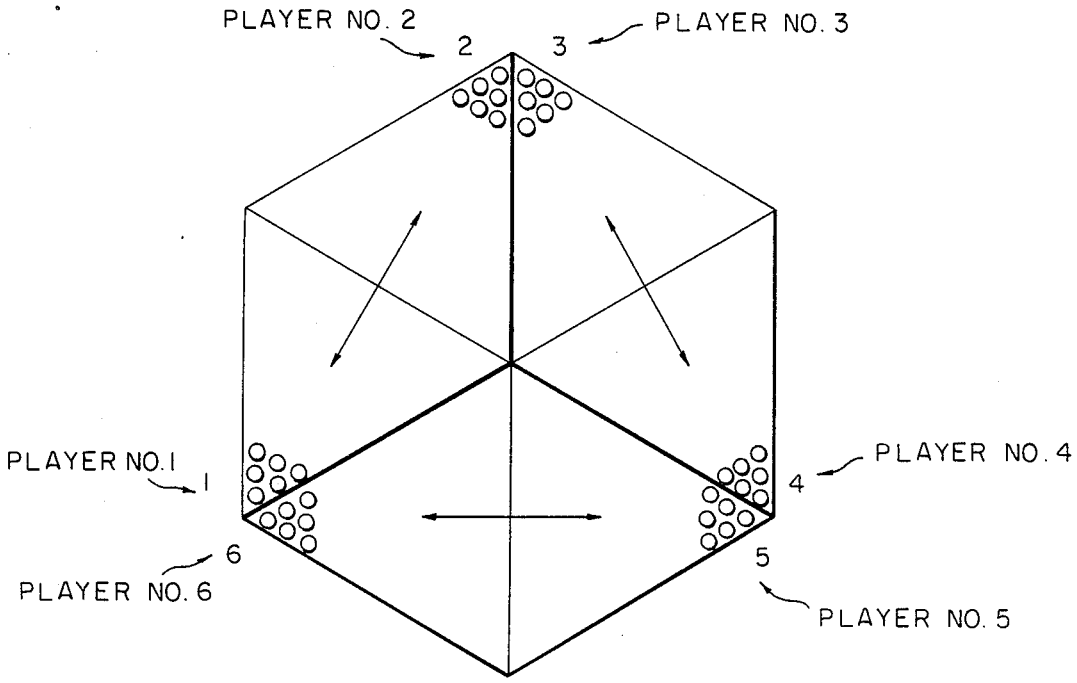
FIG. 9 is a view similar to FIG. 8, showing a different player arangement in which six players may participate in the game.

In another variation, six players will play individually, with each player occupying a corner of one of the segments and playing against an opponent in the opposite of that segment (see FIG. 9).

In yet another variation, six players may play as two teams. In this version, each player plays against an opponent in the corner of the segment opposite him, and the first player to either take his opponent's "U" piece or to occupy his opponent's "home" corner has won the game for his team. After three players have defeated their opponents, the respective team scores are listed on the score sheet.

Any version of the game described herein can be played utilizing the tactics or strategy of football, soccer, hockey or the military. For instance, football strategy may be involved when one piece is used to "run interference" for another piece, or kept back to block. Soccer and hockey strategies may be involved when pieces are maneuvered toward an opponent's corner (goal), with one piece perhaps being left back to protect that player's own corner (goal). Military strategies are available in an endless variety of possibilities and combinations. For instance, pincer movmements may be practiced; or a full frontal attack carried out; or diversionary maneuvers performed; etc.

The playing pieces may be manufactured from any suitable material, such as plastic, and may be molded or otherwise suitably formed.

Although this invention has been described with reference to particular embodiments, it is to be understood that these embodiments are merely illustrative of the application of the principles of the invention. Numerous modifications may be made therein and other arrangements may be devised without departing from the spirit and scope of the invention.

I claim:

1. A multi-use board game, comprising:

a relatively rigid game board having first and second playing surfaces on opposite sides thereof;

first indicia subdividing the first playing surface into four identical adjoining playing areas, said playing areas each being representative of a home or starting area for one each of a plurality of players;

second indicia subdividing the second playing surface into three identical adjoining playing areas, said playing areas each being representative of a home or starting area for one each of a plurality of players;

third indicia uniformly spaced throughout each playing area on both playing surfaces, subdividing each playing area into a plurality of closely adjacent identical playing spaces for playing substantially the same game or both playing surfaces, said first playing surface having a different number of playing areas theron than said second playing surface and the number of playing spaces on the first playing surface being different than the number of playing spaces on the second playing surface, for accommodating different numbers of players;

fourth indicia subdividing said playing areas on said second playing surface into additional playing areas, whereby the additional playing areas may accommodate additional players; and a plurality of playing pieces for each of a plurality of players, said playing pieces adapted to rest on said playing spaces and be movable from one playing space to an adjacent playing space.

2. A board game as claimed in claim 1, wherein:

said first playing surface is substantially square shaped in plan view, and each of the playing areas defined therein is substantially square shaped in plan view; and said second playing surface is hexagonally shaped in plan view, with each of said playing areas defined by said second indicia being diamond shaped in plan view, and each of the playing areas defined by said fourth indicia shaped as an equilateral triangle in plan view.

3. A board game as claimed in claim 2, wherein: there are six playing pieces for each player.

* * * * *